US005253596A

United States Patent [19]

Bono Coraggioso

[11] Patent Number: 5,253,596

[45] Date of Patent: Oct. 19, 1993

[54] METHOD AND UNIT FOR THE THERMAL DESTRUCTION OF POLLUTANT WASTES

[75] Inventor: Corrado Bono Coraggioso, Milan, Italy

[73] Assignee: Bono Energia S.P.A., Milan, Italy

[21] Appl. No.: 877,201

[22] Filed: May 1, 1992

[30] Foreign Application Priority Data

May 10, 1991 [IT] Italy ..... MI91A 001287

[51] Int. Cl.[5] ..... F23B 5/00; F23M 13/00

[52] U.S. Cl. ..... 110/211; 110/212; 110/316

[58] Field of Search ..... 110/315, 316, 210, 211, 110/212, 213, 214

[56] References Cited

U.S. PATENT DOCUMENTS

| | | | |
|---|---|---|---|
| 2,929,342 | 3/1960 | Yong | 110/211 |
| 4,389,186 | 6/1983 | Kawamura . | |
| 4,394,839 | 7/1983 | Toshio | 110/211 |
| 4,441,436 | 4/1984 | Hayashi | 110/316 |
| 4,509,435 | 4/1985 | Adams | 110/212 |
| 4,700,637 | 10/1987 | McCartney | 110/211 |
| 4,716,842 | 1/1988 | Williams | 110/211 |
| 5,161,966 | 11/1992 | Obermueller | 110/212 |

FOREIGN PATENT DOCUMENTS

| | | |
|---|---|---|
| 0304532 | 3/1989 | European Pat. Off. . |
| 2651561 | 3/1991 | France . |
| 1465310 | 2/1977 | United Kingdom . |
| 2155161 | 9/1985 | United Kingdom . |

*Primary Examiner*—Henry C. Yuen

*Attorney, Agent, or Firm*—Cushman, Darby & Cushman

[57] ABSTRACT

A method and a unit for the thermal destruction of industrial fluid wastes in which first and second heating phases are performed by mixing the combustion gases with the fluid wastes into combustion chambers, maintaining the mixture under high turbulence conditions to bring it to a thermodestruction temperature at which the mixed fluid waste is destroyed by heat; the gaseous mixture is maintained in adiabatic conditions at the thermodestroying temperature for a predetermined period of time along a path extending along most of a primary combustion chamber of the destroyer unit. The thermodestroyer unit has a monolithic structure which develops vertically, comprising a primary combustion chamber and an annular stay chamber, which surrounds the primary combustion chamber in which the burning mixture is maintained in a substantially adiabatic condition; the apparatus may be provided with a heat exchanger arranged at the outlet of the stay chamber.

7 Claims, 3 Drawing Sheets

METHOD AND UNIT FOR THE THERMAL DESTRUCTION OF POLLUTANT WASTES

BACKGROUND OF THE INVENTION

The present invention relates to a method and a unit for the incineration or the thermal destruction of fluid wastes, in particular pollutant industrial wastes, be they in a liquid or gaseous state, by means of which it is possible at the same time to regenerate heat for technological uses or for other applications.

As is known, many industrial processes give rise to the formation of liquid or gaseous effluent or waste which, if not appropriately treated or disposed, would involve serious hazards for the environment as well as for man. The elimination of toxic or harmful wastes is especially critical since their recycling, or their elimination in a controlled dump, is often found to be impossible or inadvisable.

For these and other reasons various physical, chemical or biological treatment systems have been developed for the elimination of wastes, which have led to various plant engineering and process solutions.

The choice of the type of disposal plant and process generally depends on the type of waste, in addition to considerations of an economic and environmental nature.

Systems for the thermal destruction of wastes have also been developed which enable wastes to be decontaminated by means of high level thermal energy, such as to cause the breakdown of complex molecular bonds thus enabling total oxidation and simpler molecules, or substances which are harmless to man and which do not damage the environment, to be obtained.

For these reasons various systems for the thermal destruction of fluid wastes have been proposed whereby the wastes in the gaseous or pulverized state are fed into an incineration plant where they are heated to a high temperature level and maintained at this temperature for a residence or stay time sufficient to cause its total destruction.

More particularly plants with a single combustion chamber have been developed, in which the waste in a gaseous or pulverized state is injected and treated with the flame of a burner which rapidly raises its temperature bringing it to a required value. In general the use of a single combustion chamber does not ensure adequate remixing of the combustion gases with the gaseous or liquid pulverized waste nor total destruction of the same, so that there is serious risk of emission of unburnt or incompletely destroyed parts which may be trapped by the combustion fumes and emitted with them, polluting the environment.

Moreover, incomplete combustion of wastes or combustion thereof at insufficiently high temperatures or an insufficient stay time at this temperature may in any case involve the risk of emission of toxic or harmful substances, such as dioxine and furanes, a risk which must in all cases be eliminated or reduced to totally insignificant levels, below a strictest threshold.

Thermal destruction plants have also been developed with several combustion chambers formed by several sections connected in series, comprising a primary combustion chamber where the waste is blaze with the flame of a burner to bring it to a first temperature level, followed by a postcombustion chamber in which, by means of a secondary burner, the fumes from the primary combustion chamber are further heated to a second temperature level, equal to or higher than the temperature of thermal destruction. The postcombustion section is in turn connected to a stay chamber where the gases remain for a predetermined time at the temperature of thermal destruction before being sent to the stack, directly or through a heat regeneration system.

A similar plant is therefore developed on the level, the various sections being connected one to the other in series, in this way forming a several operative unit system with considerable overall dimensions, difficult to control and with lengthy running times. Moreover, from the point of view of thermal efficiency and waste destruction efficiency, these plants are not always found to be adequate or useable.

An object of the present invention is to provide a method and an unit for the thermal destruction of fluid wastes, designed to achieve high thermal and waste destroying efficiency, given that the combustion gases are maintained in a highly turbulence condition not only in the whole, but also in particular points of their path. In this way the emission of unburnt parts and/or hazardous substances due to incomplete destruction is avoided.

A further object of the present invention is to provide a method for the thermal destruction of pollant industrial waste effuents which requires small volumes of air and which enables high temperatures to be reached using a monolithically structured destroyer unit having small overall dimensions and relatively small volume.

A further object of the present invention is to provide a method and apparatus for the thermal destruction of industrial waste effluents, as explained previously, which enable operations under pressurized conditions, and therefore easy to operate and to control.

Yet a further object of the invention is to provide apparatus for the thermal destruction of industrial waste effluents in which the reaction takes place in substantially adiabatic conditions, along a path which develops substantially in a vertical direction.

A further object of the present invention is to provide apparatus as defined above which has a monobloc structure integrated with a heat regeneration section for the combustion gases, before the latter are sent to a stack, so as to reduce drops in pressure as far as possible, also making the heat regenerator and the entire apparatus easily accessible for their maintenance.

Yet a further object of the present invention is to provide a method and apparatus for the thermal destruction of waste effluents, as defined, which allow the pollutants emitted with the combustion fumes to be controlled accurately, maintaining them substantially below established legal levels.

SUMMARY OF THE INVENTION

These and other objects of the present invention can be achieved by means of a method and apparatus for thermal destruction of industrial fluid wastes in which first and second heating phases are performed by mixing the combustion gases with the fluid wastes into combustion chambers, maintaining the mixture under high turbulence conditions to bring it to a thermodestruction temperature at which the mixed fluid waste is destroyed by heat; the gaseous mixture is maintained in adiabatic conditions at the thermodestroying temperature for a predetermined period of time along a path extending along most of a primary combustion chamber of the destroyer unit. The thermodestroyer unit has a monolithic structure which develops vertically, comprising a primary combustion chamber and an annular stay chamber, which surrounds the primary combustion chamber in which the burning mixture is maintained in a substantially adiabatic condition; the apparatus may be provided with a heat exchanger arranged at the outlet of the stay chamber comprising the characteristic features of the main claims 1 and 8.

BRIEF DESCRIPTION OF THE DRAWINGS

The invention will be described in greater detail hereinbelow with reference to the accompanying drawings, in which.

DESCRIPTION OF THE INVENTION

Figure 1:
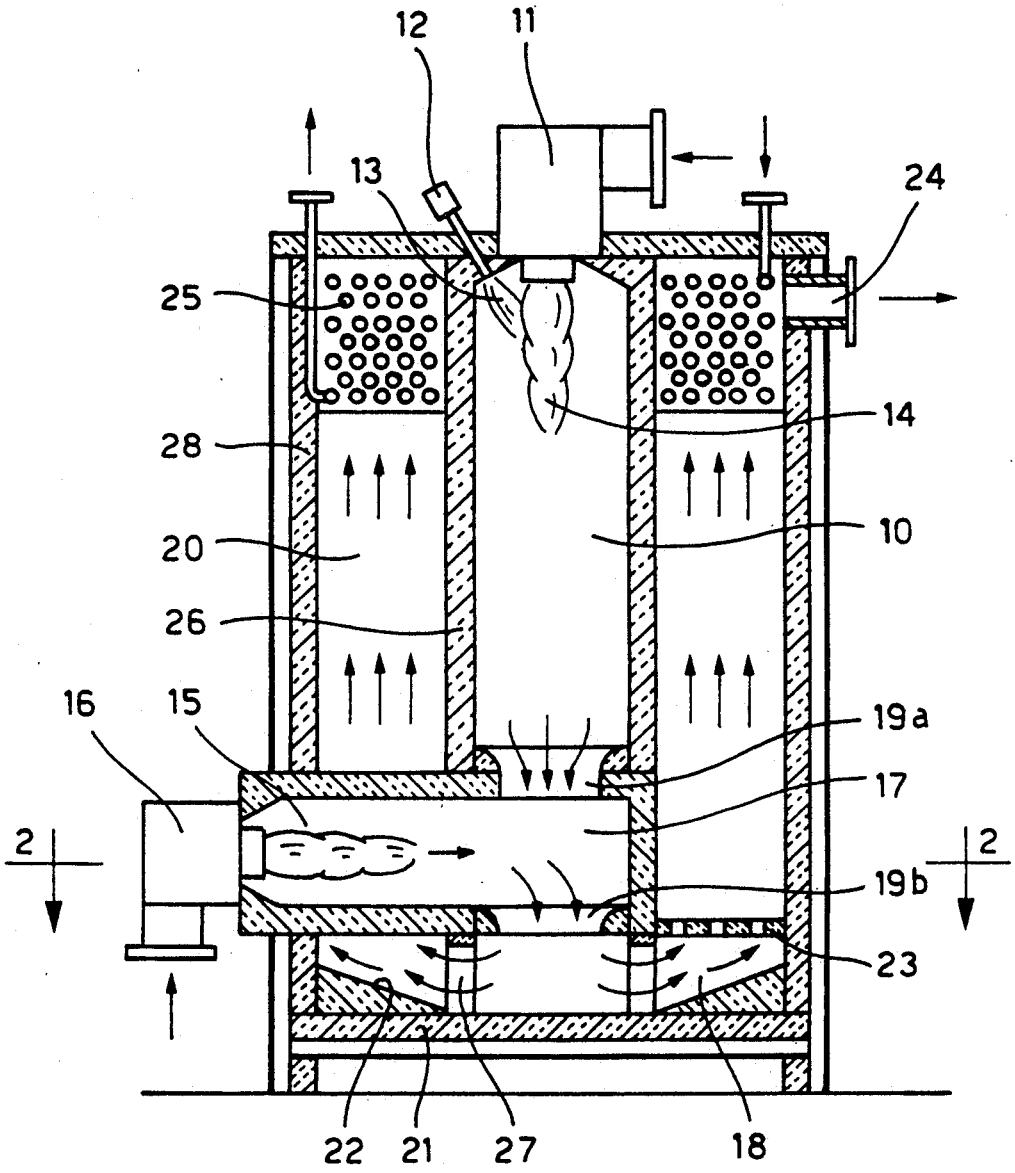
FIG. 1 is a diagram of a first embodiment of apparatus according to the invention, illustrating its operating mode.

As shown in FIG. 1, the apparatus or unit for the thermal destruction of liquid and gaseous waste effluents according to the present invention comprises a primary combustion chamber 10, having a substantially extended cylindrical shape, which is arranged vertically and above a secondary combustion chamber described further on. At the upper end of the primary combustion chamber 10 a main burner 11 is provided, positioned centrally, as well as one or more waste injector means 12 for feeding the waste effluent or effluents 13 to be destroyed. As shown, the injector 12 is arranged at an angle in relation to the burner 11 so as to feed the waste effluent 13, in a pulverized condition or gaseous form, in an appropriate burning zone with respect to the flame 14.

Below the primary combustion chamber 10, there is an intermediate gas reaction and mixing zone 17 into which leads both the primary combustion chamber 10 and a secondary combustion chamber 15, considerably smaller in volume, which is arranged horizontally and is provided with a secondary burner 16 to bring the mixture of gas and waste effluent leaving the primary chamber 10 to a higher temperature level, corresponding to or higher than the temperature of thermal destruction of the effluent as explained hereinunder.

Figure 2:
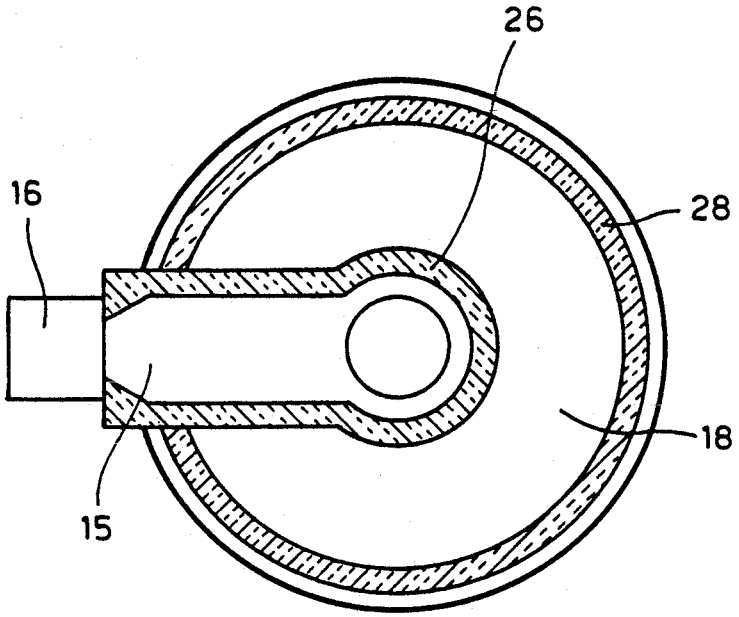
FIG. 2 is a cross-sectional view along line 2—2 of FIG. 1.

The secondary combustion chamber 15, as shown in FIGS. 1 and 2, leads into the mixing zone 17 transversely to the combustion chamber 10 and has its longitudinal axis coplanar at 90° with the longitudinal axis of the main combustion chamber 10, in such a way that the flow of the mixture of hot gases leaving the chamber 15 laterally impinges with the main descending flow of gas coming out of the main chamber 10 and is mixed with the latter. The substantially transverse flow direction of the secondary combustion gases, with respect to the main flow of gas, is such that a strong swirling or turbulent action is created which causes intensive mixing of the waste effluent and of the combustion gases in the zone 17 of the path of the fumes, defining an intermediate reaction and mixing chamber, followed by a flow reversal chamber 18 for reversion and distribution of the hot gases feeding them in an adiabatic stay chamber 20, surrounding the main chamber 10 in a manner described hereinunder.

As shown in FIG. 1, the main combustion chamber 10 is connected to the mixing zone 17 by a central aperture or nozzle **19*a*, of reduced dimensions so as to create an acceleration of the gas flow leaving the chamber 10 which is in turn transversely impinged by the flow of hot gases from the secondary combustion chamber 15** mentioned previously.

As shown, the secondary combustion chamber 15 and the intermediate flow reversal chamber 18 are located at the lower end of the primary combustion chamber 10 and are directly open to the flow reversal chamber 18 close to the floor or base 21 of the apparatus; in this way the overall dimensions and height of the entire apparatus are substantially reduced. Moreover, as related previously, the mixture of gases passes from the mixing zone 17 to the flow reversal chamber 18 through a nozzle **19*b*, where gases, due to the inversion of flow, undergo a further swirling effect with a turbulent condition which further improves the degree of mixing. The reversal and gas distribution chamber 18 in turn leads into a gas stay chamber 20, where the gases remain at the temperature of thermal destruction of the waste effluent for a predetermined period of time, sufficient to allow the total and safe thermal destruction of the waste. The hot gases then pass from the stay chamber 20** to the stack or through a heat regeneration section, illustrated hereinunder.

As shown in FIG. 1, the stay chamber 20 has an annular shape which develops coaxially around the primary combustion chamber 10 extending for most of the chamber 10 at least. In this way the chamber 20 defines an adiabatic reaction zone in which the upwardly flowing gases are thermally insulated externally by the refractory walls of the apparatus and, internally, by the same combustion gases which flow downwardly along the primary chamber 10 and which contribute to maintain them at a substantially constant temperature.

As can be seen again from FIG. 1, the combustion chambers 10 and 15, the mixing zone 17, the flow reversal and distribution zone 18 and the stay chamber 20 constitute as a whole a pressurized environment in which the flow of gas move along a first descending path, downwards, from the primary combustion chamber 10 towards the zone 18, and are then diverted laterally and upwards along the stay chamber 20, surrounding the primary combustion chamber totally.

The described process of thermal destruction of waste effuents and the working of the apparatus occur as follows: the fluidized wastes 13 coming out of the inyection nozzle 12, after having been distributed in the primary combustion chamber 10, are subjected to the flame 14 of the burner 11 to be heated and brought to a high temperature, for example between 750° and 900°, close to the temperature of thermal destruction.

From the primary combustion chamber 10 the gases pass into the mixing zone 17 to be accelerated through the nozzle **19*a* where they meet the gases coming from the secondary combustion chamber 15, mixing with them. Given the orthogonal arrangement of the two flows of gas, and due to the acceleration supplied by the nozzle 19*a* to the flow of gas coming out of the main combustion chamber 10, a strong turbulence state of the gases is caused in the mixing zone 17 which is furtherly increased by the nozzle 19***b* in the passage to the flow reversal zone 18. In the zone 18 the flow of gases mixture is reversed upwards and distributed by means of a 180° inversion which increases the turbulence state at the inlet of the annular stay chamber 20. The reversion and the distribution of the flow of gas can be facilitated by any suitable means, for example by providing a conical or upwardly and outwardly diverging bottom wall, denoted by 22. In combination with or in place of the conical wall 22, a perforated plate 23 can be provided which divides the reversal zone 18 from the stay chamber 20, so as to render the distribution of gas in the chamber 20 homogeneous, further increasing mixing.

The turbulence conditions are therefore so strong as to affect not only the main flow, but also localised turbulences are generated in the various points of the zones 17 and 18, improving overall the degree of mixing and hence the conditions of thermal reaction in the process of thermal destruction of the wastes.

Therefore the mixture of the gases and of wastes in the mixing zone 17 is immediately brought to a second temperature level, equal to or higher than the required temperature for thermal destruction, for example to a temperature between 950° C. and 1400° C., to flow to the stay chamber 20 after having passed through the reversal and distribution zone 18.

Having crossed through the reversal and distribution zone 18, the gas comes out into the stay chamber 20 where it flow upwardly remaining for a predetermined period of time before leaving the stack 24 or being sent to a heat regenerator 25.

The thermal destruction of waste effluents, by means of a double combustion along a vertical path, with crossed flow mixing, provides several advantages including that of obtaining a homogeneous temperature for all the molecules of the waste to be destroyed, a stay time at the constant and uniform maximum temperature of thermal destruction, as well as a high degree of process safety since the whole process takes place in a pressurized mode. In fact combustion in a pressurized environment makes adjustment of the various process parameters easier and safer. Moreover the use of a double, cross-flow combustion chamber with an intermediate mixing zone, according to the present invention, means that any heavy drop of waste and unburnt gases are necessarily drawn from the chamber 10 into the zone 17 and rigorously mixed with the gases coming from the secondary combustion chamber 15, before arriving in the reversal and distribution zone 18 and in the stay chamber 20. The strong swirling of the gases thus ensures total destruction of the waste effluents. Moreover, feeding the secondary combustion with a relatively small excess of air, at a value which can be controlled and predetermined, not only allows substantial savings in heat, due to the small volumes of the combustion products, but also an adequate control of the fumes emitted at the stack.

Figure 3:
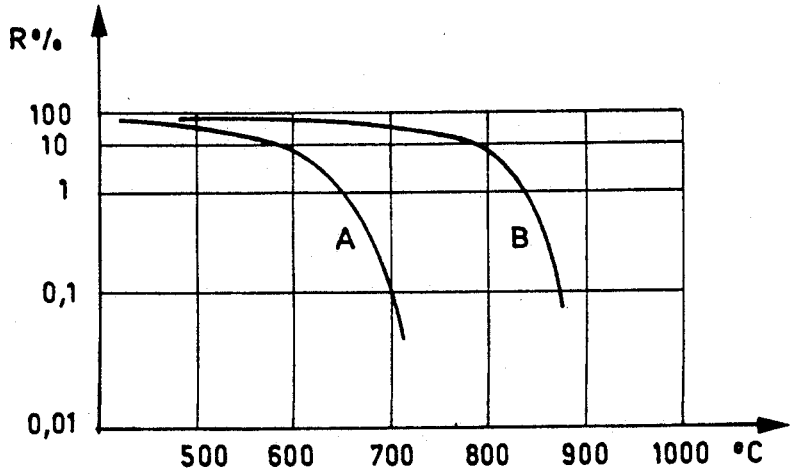
FIG. 3 is a graph indicating the percentage of residual dioxine in the fumes, at various temperatures of thermal destruction, for a predetermined stay time.
Figure 4:
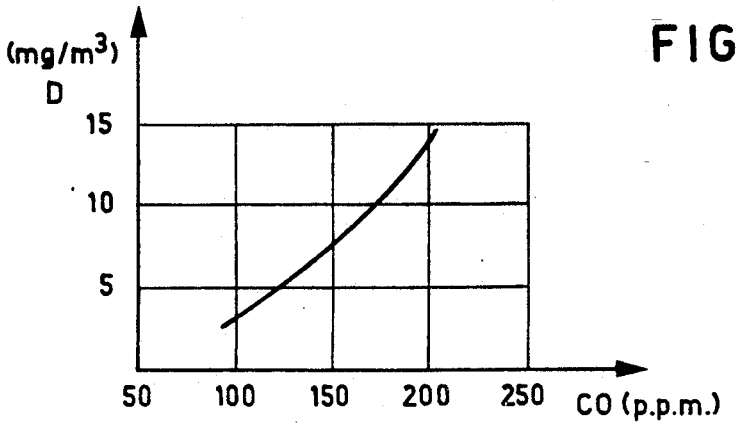
FIG. 4 is a graph showing the variation of dioxine and furanes at various concentrations of carbon monoxide in the fumes.

The graphs in FIGS. 3 and 4 demonstrate the importance of reaching and maintaining high temperatures and obtaining complete combustion, further highlighting the characteristic features and advantages which can be achieved with an apparatus or a destroyer unit operating on the basis of the thermal destruction process according to the present invention.

More particularly FIG. 3 shows the dioxine residue percentage as the temperature increases, with a stay time of the gases in the chamber 20 having a predetermined value, for example one second. Curve A in FIG. 3 shows the results of experimental tests obtained with the present invention, while curve B shows the theoretical values obtained by calculations based on the theory of molecular kinetics.

Curve A in FIG. 3 shows the clear advantages which can be obtained with apparatus and a method according to the invention, since even at 700° C. the dioxine residue is reduced to 0.1% while the same percentage on the theoretical curve B would be obtained at a higher temperature of approximately 880° C. In general it can be said that the high temperature which can be reached in apparatus according to the invention enables the dioxine residue percentage and that of other pollutant substances to be substantially reduced to extremely low levels even at temperature values equal to those which can be obtained in the primary combustion chamber. Thus the higher temperature and the greater degree of mixing which can be obtained along the mixing and reversal zones, in addition to ensuring exceptional rapidity of combustion and high thermal-volumetric loads, is fully advantageous with respect to the limiting of the dimensions of the apparatus, increasing reliability and safety.

FIG. 4 of the drawings also shows the importance of constantly controlling the presence of carbon monoxide (CO) in the combustion fumes in order to control the emission of dioxine and/or furanes efficiently. This control is thus hugely simplified by operating under pressurized conditions by means of apparatus according to the invention. In other words apparatus according to the invention has a high degree of safety and high reliability.

Figure 5:
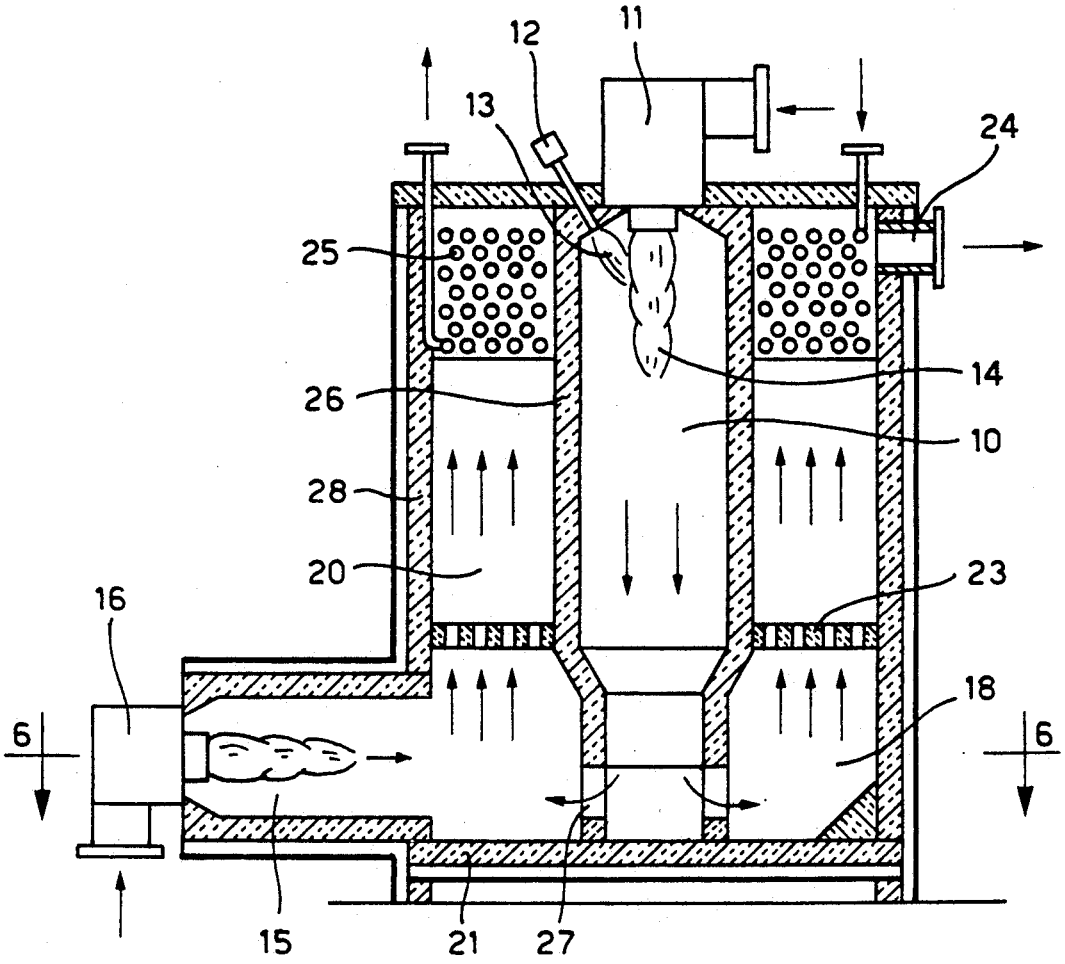
FIG. 5 is a longitudinal section of a second preferential embodiment.
Figure 6:
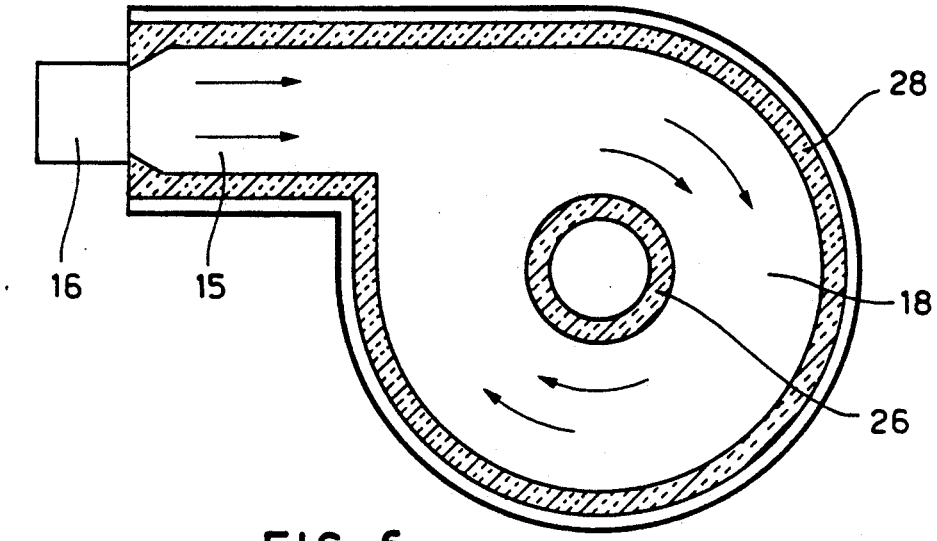
FIG. 6 is a cross-sectional view along line 6—6 of FIG. 5.

In the case in FIG. 1 a substantially coplanar arrangement of the combustion chamber 10 and 15, or of their longitudinal axes, is provided, maintaining the mixing zone 17 separate and distinct from the zone 18 for distribution and reversal of the flow of gas mixture. FIGS. 5 and 6 show an alternative solution which makes use of the same innovative principles of the present invention and which provides a different arrangement of the secondary combustion chamber 15 and of the intermediate mixing zone. Therefore in FIGS. 5 and 6 the same numerical references have been used as in the previous FIGS. 1 and 2 to denote similar or equivalent parts.

The solution in FIGS. 5 and 6 differs from the previous one in that the mixing zone now coincides with the distribution zone 18, and due to the fact that the secondary combustion chamber 15 now leads tangentially and directly into the distribution zone 18 creating a swirling and circulatory motion of the gases before they pass into the stay chamber 20.

According to a further characteristic feature of the invention, the apparatus, at the outlet of the stay chamber 20, has a heat regenerator 25 arranged coaxially to and encircling the upper section of the primary combustion chamber 10. More precisely, the apparatus consists of an internal structure in refractory, denoted by 26, defining the primary combustion chamber 10, said structure 26 extending as far as the floor 21 where it leads into the reversal zone 18 through radial passages or apertures 27. The apparatus comprises moreover an external structure 28, provided with a suitable lining in refractory which, with the internal structure 26, defines the annular chamber 20 for stay of the gases at a temperature of thermal destruction, as well as a successive annular chamber which holds the tube bundle of the heat regenerator 25. Advantageously, the heat regenerator 25 is composed of a tube bundle with staggered archimedean spirals so as to restrict drops in pressure and allow easier cleaning and maintenance. Therefore the combustion gases which leave the stay chamber 20 pass through the tube bundle 25, moving along it from the bottom upwards, to then flow to the stack through the conduit 24.

From what has been said and shown in the accompanying drawings it is clear therefore that a waste destroyer apparatus or unit has been provided for the thermal destruction of fluid industrial wastes, in particular pollutant waste effluents, which has a monobloc structure, suitably integrated with a heat regenerator, in which the flow path of the gases develops in a substantially vertical direction, and in which the unit works under pressurized condition, providing an upwardly oriented path of the gases along an annular stay chamber which is maintained in substantially adiabatic conditions by the same gas inside the apparatus. This enables all the process variables to be controlled automatically in a simple and integrated manner.

The arrangement of the heat regenerator annularly and outside of the primary combustion chamber enables heat to be regenerated, due to convection from fumes and also to irradiation from the refractory, which thus improves its resistance and service life.

What is claimed is:

1. Method for the thermal destruction of liquid and gaseous industrial waste effluent, whereby the waste effluent is injected into a primary combustion chamber where it is mixed with the combustion gases of a primary burner to form a first mixture heated to a first temperature level, subsequently the first mixture of gases and waste effluent is further heated by the combustion gases of a secondary burner to form a second mixture which combustion is brought to a second temperature level corresponding to a temperature of thermal destruction of the waste, then maintaining said mixture at said second temperature level for a predetermined period of time, the method comprising the steps of:

feeding said first mixture of gas and waste effluent into an intermediate mixing zone where strong turbulence condition are created by impinging said first gas mixture with a flow of secondary combustion gas transversely fed to the flow of the above mentioned first gas mixture;

and maintaining said mixture of gas and waste effluent in adiabatic conditions at said temperature of thermal distruction by reversing it along an annular path which surrounds and develops at least for most of said primary combustion chamber.

2. Method according to claim 1, in which a primary combustion phase, a secondary combustion phase, the mixing and reversal of gas mixture as well as the stay of the mixture at the thermal destruction temperature and a heat regeneration phase occur in a pressurized environment.

3. Method according to claim 1, in which said primary combustion and mixing phases, and the stay of the gases at said temperature of thermal destruction respectively, occur along oppositely directed vertical paths for the gases.

4. Method according to claim 1, in which the flow of gas from said primary combustion chamber and the flow of gas from secondary combustion chamber are mixed with an excess of combustion air.

5. Method according to claim 1, in which turbulence conditions of the gas mixture are generated along said path between said primary combustion chamber and the stay chamber mentioned above.

6. Method according to claim 5, in which the turbulence conditions of the gas mixture are maintained by increasing the output velocity of the mixture from the primary combustion chamber and/or after the mixing with the secondary combustion gases from said secondary combustion chamber.

7. Method according to claim 1, in which a thermal insulation is provided and adiabatic conditions are maintained from inside along said annular path, by means of the hot gases flowing along said primary combustion chamber.

* * * * *